US005462116A

United States Patent [19]

Carroll

[11] Patent Number: 5,462,116

[45] Date of Patent: Oct. 31, 1995

[54] METHOD OF PRODUCING METHANE GAS FROM A COAL SEAM

[76] Inventor: Walter D. Carroll, 12111 Burgoyne Dr., Houston, Tex. 77077

[21] Appl. No.: 329,458

[22] Filed: Oct. 26, 1994

[51] Int. Cl.[6] ..... E21B 43/00

[52] U.S. Cl. ..... 166/249; 166/250.15

[58] Field of Search ..... 166/250, 253, 166/254, 369; 175/40, 45, 48, 50

[56] References Cited

U.S. PATENT DOCUMENTS

| | | | |
|---|---|---|---|
| 4,544,037 | 2/1984 | Terry | 166/369 |
| 5,273,113 | 12/1993 | Schultz | 166/250 |
| 5,318,125 | 6/1994 | Wittrisch | 166/250 X |
| 5,350,018 | 9/1994 | Sorem et al. | 166/250 X |
| 5,377,160 | 12/1994 | Tello et al. | 166/253 X |

*Primary Examiner*—Michael Powell Buiz
*Attorney, Agent, or Firm*—C. Dean Domingue

[57] ABSTRACT

A method and system for producing coal-bed methane gas from a wellbore is disclosed. The method consists of drilling a wellbore so that a coal seam is intersected, and thereafter casing and completing the wellbore. A transducer is lowered into the wellbore, with the transducer capable of converting electrical energy to a sound energy. The transducer is activated, and methane gas is then produced from the coal seam. The energy to the transducer may be varied so that a maximum rate of methane gas production is obtained.

14 Claims, 2 Drawing Sheets

METHOD OF PRODUCING METHANE GAS FROM A COAL SEAM

BACKGROUND OF THE INVENTION

This invention relates to coal bed methane gas. More particularly, but not by way of limitation, this invention relates to a method of in situ producing methane gas from underground coal seams.

While coal has long been recognized as a major source of energy, it also contains vast quantities of methane gas. The gas is believed to have been produced during the transformation of vegetation to coal during geologic time and retained within the coal seams by virtue of their low permeability and diffusivity. This methane source is not new, since coal mine operators have been acutely aware of its presence. In fact, during mining operations, the release of the methane into the atmosphere has become an important safety factor and environmental concern.

The difficulty of harnessing the methane gas from these coal seams has made it difficult to assess the commercial potential of methane gas. Nevertheless, significant reserves of methane gas are known to exist. Methane gas occurs in an adsorbed form in the coal seam.

Studies have indicated that a ton of anthracite today occupying a volume of less than 30 cubic feet have generated in the order of 10,000 standard cubic feet of methane during its lifetime. It is estimated that the surface area of one pound of coal is from 100,000 sq. ft. to in excess of 1,000,000 sq. ft. Coal containing 27% volatile matter can absorb (at 77 deg) up to 640 scf/ton with a monomolecular layer of methane molecules, at 4 angstroms in diameter. Gas is stored primarily by sorption into the coal, also gas is stored in the pore or cleat space. The United States Bureau of Mines has collected data that have indicated a gas-in-place magnitude between 300 and 400 Tcf from a combination of minable and unminable coal seams.

(Coal deposits are naturally fractured gas reservoirs. In fact, the methane found in the coal seam reservoir is the same as methane found in the petroleum industry's sandstone and carbonate reservoirs; consequently, a coal bed methane well reservoir is similar to a dry natural gas from a conventional gas reservoir. Coal gas is almost 100% comprised of methane, with just trace amounts of other gases.

Wells completed in coal deposits go through three distinct production stages. The first stage includes the production of trace amounts of gas and in situ water. During this initial stage, the production rates of both products are essentially constant. Generally, the water production rate is the highest rate that the well will ever see. Periodically, it is necessary to pump by mechanical means the water out of the wellbore as a way to produce in-situ water and gas. The methane production rate is initially characterized by a low rate; however, the methane does increase at a relatively constant rate. The first stage may last only a short time in comparison to the overall life of the well; hence, many first stage productions last from two to six months. The wells must be de-watered so as to reduce the hydrostatic pressure on the coal face. This reduced hydrostatic pressure will allow the methane to diffuse from the coal face.

The second stage is characterized by rapid water production decline, and simultaneously, increased methane production. The water withdrawal continues for a period of time, for example for months, while adsorbed methane is desorbing from the micropores of the coal face and begins to flow into the fracture system that is ultimately connected to the wellbore. The desorbed methane production will begin increasing during this time.

The third stage is defined by maximum rate of the gas production and a markedly reduced water rate. Nevertheless, water must still be pumped through out the life of the well. This has been referred to by those of ordinary skill in the art as the "reverse decline curve". The negative decline continues ascending for an extended period of time, for example 30 years, depending upon well spacing of offset wells and the height and size and gas content of the coal seam. The third stage spans most of the productive economic life of the coal bed methane well.

During this third stage, the coal bed methane well behaves as a dry gas reservoir with the only difference being that the gas is stored in the coal bed by sorption in the coal matrix. The dewatered coal bed methane gas is produced at a slightly declining base line that can last for years. The well must be periodically dewatered so as the methane gas can continue to flow and the gas be placed in a pipeline and sold.

Prior art methods of production include providing a bore hole, which is generally vertical, to a depth that intersects a plurality of coal seams. The bore hole depths normally range from 1250' to 7500'. Coal deposits are naturally fractured gas reservoirs. Initially, the natural fractures, or cleats, of the coal are typically water-saturated and the coal matrix adsorbs most of the gas. Most of the storage of gas in coal is by adsorption into the coal structure, while the coal permeability is cleat fractured.

Despite all these advances, the optimum production rates may take some time to achieve. Further, as is applicable to natural gas subterranean reservoirs, operators continue trying to obtain maximum production rates that will maximize the sales volume, while at the same time not harm the ultimate reserve potential of the coal seam. Therefore, there is a need for a method and apparatus to increase and stimulate production of the methane gas, as well increasing ultimate recovery.

SUMMARY OF THE INVENTION

A method of producing coal-bed methane gas comprising the steps of drilling a bore hole so that a coal seam is intersected; and thereafter, casing the bore hole with cement. Next, the casing would be perforated at a depth that intersects the coal seam. The surface equipment would include a well head that is a series of valves having an open position and a closed position that controls the casing strings. Also included may be a means to pump the in-situ water, ie. a pump jack and/or downhole pump. A fracturing procedure would be performed in order to connect the naturally occurring fractures of the coal seam (cleats) with the wellbore.

The method then includes lowering a transducer into the wellbore of the casing to a depth corresponding to the depth of the perforations. The transducer, in the preferred embodiment, is capable of converting electrical energy to a sound energy. The transducer is lowered into the wellbore on an electric line capable of transmitting electrical signals from the surface to the downhole location of the transducer. Next, the transducer is activated so that the sound energy is produced. In the preferred embodiment, the sound frequency is activated at the optimum frequency of the methane molecule which corresponds to the frequency that achieves maximum methane gas production. The sound waves striking the methane molecules will start the molecule to vibrate quite vigorously. This will give the methane molecule the added energy to leave the coal face upon which it was adsorbed quicker, which will in turn be replaced with another methane molecule which will start the whole process over. The frequency of the transducer must create a sympathetic vibration and create a resonance with the methane molecule to create motion and energy, so that the molecule will vibrate off the coal face. Thus, the methane gas can be produced at an increased rate due to the vibration induced within the well. It may also be necessary to vibrate the coal itself in order to stimulate methane gas production, and the vibration of the coal is performed with the transducer in the same manner.

The method further comprises the steps of varying the frequency of the transducer in order to determine the optimum frequency. The steps include varying the electrical energy to the transducer so that a variable frequency is obtained; measuring the production of the methane gas at the surface at this variable frequency; determining a maximum rate of the methane gas production based on numerous different frequencies and the gas produced; comparing the produced frequency with the maximum rate of the methane gas production in order to obtain the optimum frequency of the transducer.

The application also discloses a system for the production of methane gas from a coal seam, with the system comprising a casing string, with the casing string intersecting a coal seam, with the casing string having a perforated portion communicating the inner diameter (annulus) of the casing string with the coal seam.

The system will also contain control means, such as a well head with a series of valves, for controlling the produced gas and water from the coal seam. The system will also contain cable means, such as an electric line commonly used in the oil and gas industry, for lowering a generating means for generating a sound vibration in response to an electrical energy input transmitted down the electric line.

The system may further comprise measurement means, operatively associated with the cable means, for measuring the location of the generating means as it is lowered into the wellbore. The system may further comprise a variable electric controller means, operatively associated with the generating means, for varying the electric current to the generating means which will have the effect of varying the sound vibration produced in response thereto which in turn varies the frequency produced by the generating means at the coal seam.

In one embodiment, the generating means is a transducer that converts input electrical energy into the sound vibration, with the sound vibration having a measurable frequency. The cable means employed may be a braided line capable of transmitting electrical signals and/or currents.

A feature of the present invention includes use of a transducer that is capable of converting an input energy, such as electricity, into output energy of another, such as sound vibrations having a measurable frequency. Another feature of the invention includes use of a rheostat at the surface that would help the manual varying of the sound frequency so as to vary the electrical current from the surface in order to determine the natural frequency for optimum methane production.

Another feature includes the use of an electric line to raise, lower, and transmit the electrical current to the transducer located in the wellbore at the location of the coal seam. Yet another feature includes the use of equipment previously used for natural gas drilling and production such as casing, perforating guns, well head, surface production facilities, etc.

An advantage of the present invention includes the ability of increasing methane gas production. Another advantage is that increasing the total recoverable gas reserves through the practice of the invention. Still yet another advantage is the calculation of the natural optimum frequency which leads to increased productivity, and the calculation of the optimum frequency is accomplished by varying the electrical current to the generating means.

Another advantage includes the capability of varying the electrical current at the surface. Still yet another advantage includes measuring the produced gas at the surface, which when done in conjunction with variation of the electrical current, the operator can determine the natural optimum frequency of the coal seam with the adsorbed methane gas. Yet another advantage includes the ability to test the coal seam at various times during the production life of the methane gas reservoir which includes during dewatering and post-dewatering.

DESCRIPTION OF THE PREFERRED EMBODIMENTS

Figure 1:
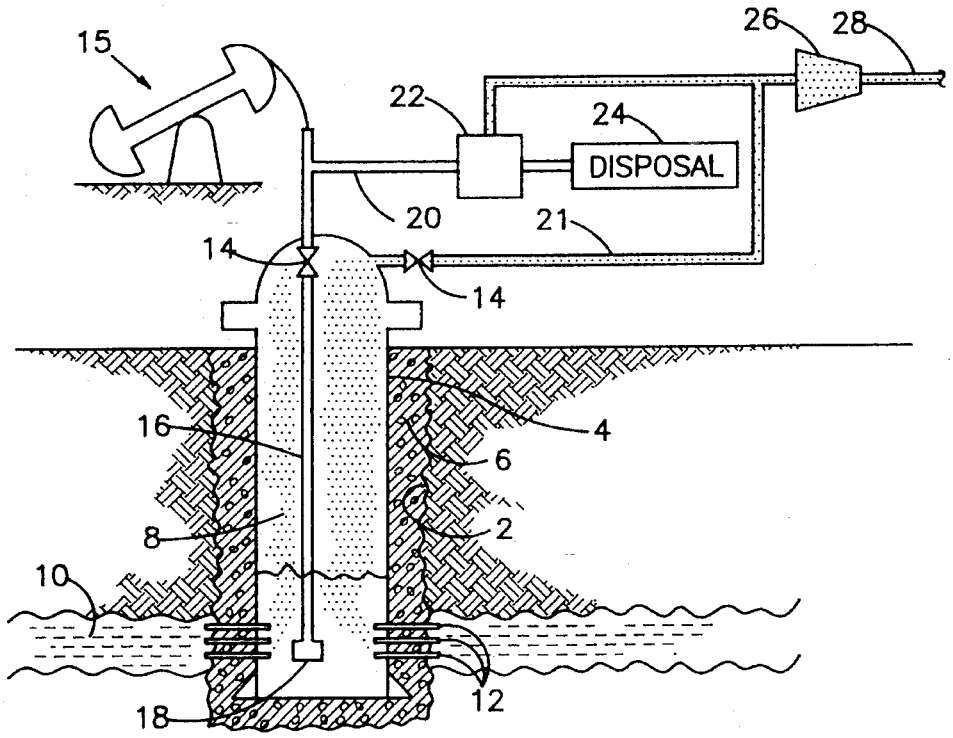
(PRIOR ART) FIGURE 1
FIG. 1 is schematic drawing of a prior art wellbore intersecting a coal seam capable of producing in situ water and methane gas.

Referring to FIG. 1, the prior art bore hole 2 has previously been drilled by conventional means such as a rotary tri-cone bit as known by those of ordinary skill in the art. Once the bore hole 2 has been drilled, the a casing string 4 is run into the bore hole 2, and thereafter cement 6 is pumped into the annulus between the casing string 4 and bore hole 2. The casing string 4 and wellbore will be used interchangeably.

In order to complete the well for production, it will be necessary to communicate the inner diameter 8 of the casing string 4 with the coal seam 10 via perforating means for perforating the casing 4 and cement 6, with the perforating means being lowered into the well bore and set off so that perforations 12 will be created (the perforation means is not shown but is well known by those of ordinary skill in the art). After perforating, the well will be fractured so that the existing natural fractures, or cleats, of the coal seam are connected to the annulus 8 for production of the in situ water and methane gas.

As seen in FIG. 1, the prior art production facilities include control valves means 14 for controlling the flow of water and natural gas from the annulus 8. The control valve means 14 may be a series of valves having an open position and closed position, as well as choke means (not shown) for varying the size of the flow area thereby controlling flow rate. The control valve means 14 is sometimes referred to by those of ordinary skill in the art as a well head 14. Most wells are de-watered by pumping with a pump jack 15, and large water makers wells may have a downhole pump.

Extending into the annulus 8 will be the conduit 16 (generally 2⅜" tubing) for dewatering the well, which in turn will have a downhole pump 18, positioned generally below the perforations 12, for pumping the water and methane entering into the annulus 8 up the conduit. Water is pumped up through the tubing and the methane gas flows up the 2⅜"—casing annulus area. The pump 18 is necessary because the hydrostatic pressure of water is greater than the formation pressure of the coal seam thereby making it necessary to initially pump the water from the annulus.

The conduit (tubing) 16 is operatively associated with the control valve means 14, and stretching from the control valve means 14 is a flow line 20 that in turn is connected to a water and natural gas separator 22 that is used to separate the fluid/gas produced from the coal seam. The produced water will be disposed of in an appropriate water disposal means 24, while the natural gas will be directed to a gas compressor 26 for eventual sale to a gas pipeline 28. It should also be noted that the methane may be flared to the atmosphere with appropriate regulatory approval.

Figure 2:
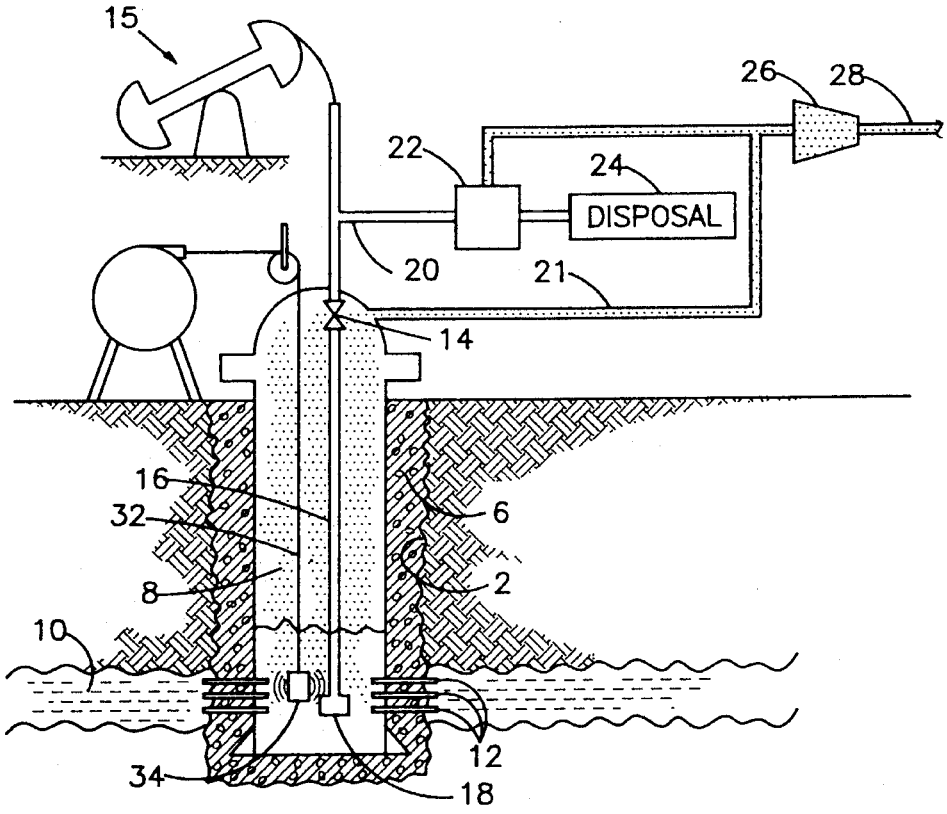
FIG. 2 is a schematic drawing of a wellbore with the transducer positioned within the wellbore at the coal seam.

Referring now to FIG. 2, the preferred embodiment of the present invention will now be described. Similar numbers in the various figures represent similar components. FIG. 2 depicts an electric line unit 30 that has contained thereon a cable 32 that is capable of transmitting an electric current to a transducer 34, with the transducer capable of converting the electrical energy current to a sound energy, with the sound energy generating therefrom being characterized by a distinct measurable frequency.

The electric line unit 30 will also have operatively associated therewith measurement means 36 for measuring the depth of the transducer so that the transducer can be accurately placed at an appropriate depth. The electric line unit 30 will also have associated therewith a rheostat 38 for regulating the electric current to the electric cable 32. The rheostat 38 would be used to manually change the electric current which would in turn change the frequency so that the operator can match the natural frequency for optimum methane production. The transducer 34 may be lowered and used in the stage 3 phase of the production life of the well i.e. after partial dewatering. However, the transducer 34 may also be lowered into the downhole position during the dewatering phase in order to test the well, which will be described hereinafter.

Figure 3:
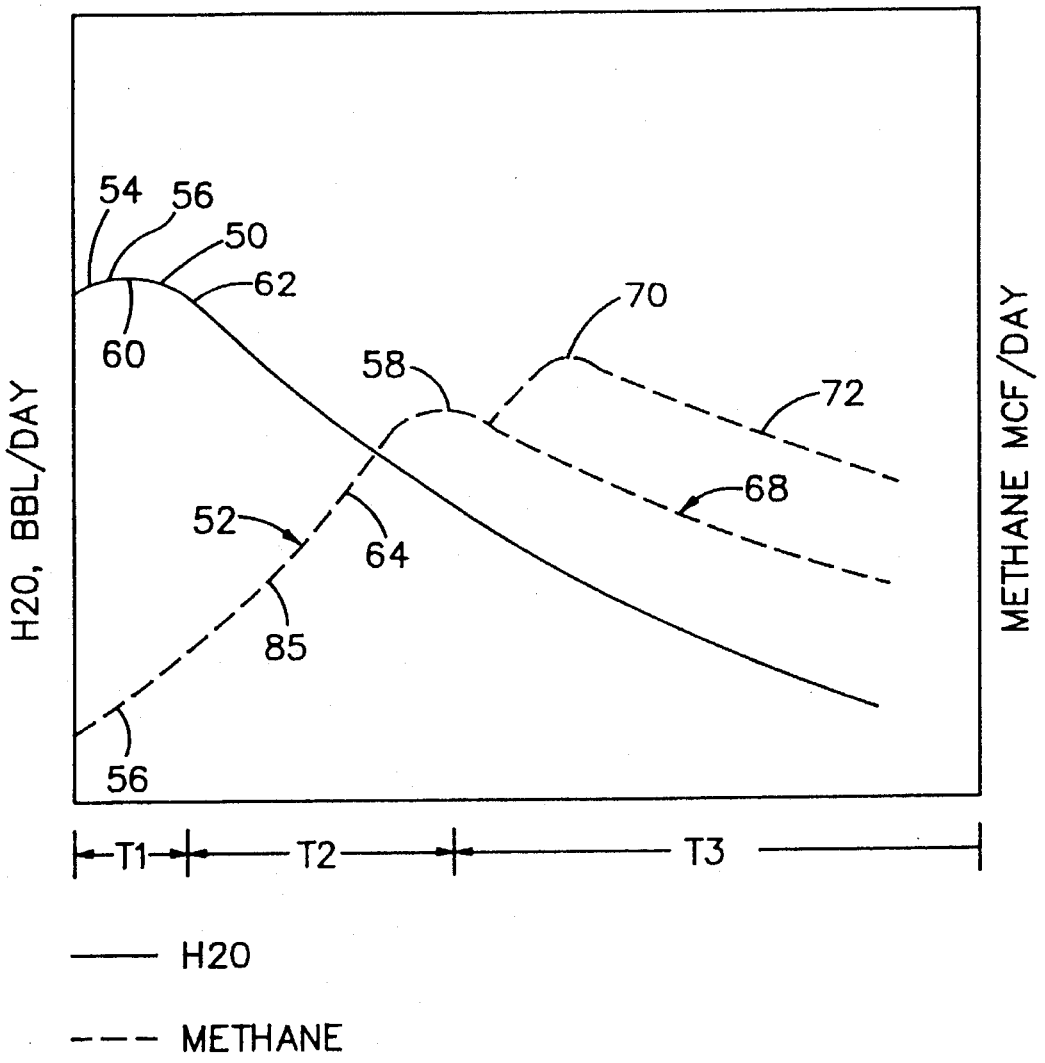
FIG. 3 is a graphical representation of methane gas and water production showing an incremental increase in methane gas production.

Referring to FIG. 3, a typical coal seam methane well cycle will be described. It should be remembered that the necessary drilling, setting casing, cementing, perforating, and fracturing has been accomplished as shown in FIG. 1. Further, the conduit 16 with the downhole pump 18 is now in place. The water production curve is represented in general by numeral 50 and the methane gas production curve is represented in general by numeral 52. It should be noted that the production patterns may vary with different wells and different coal seams. The teachings of this invention are applicable to all the various production patterns that may be encountered, and not just the pattern set out in FIG. 3.

Wells completed in coal deposits go through three distinct characteristics as shown in FIG. 3. The first stage is characterized by a water rate 54 that historically is the highest shortly after bringing the well on line by pumping action. Simultaneously, the methane production commences, increases 56 and then slowly increase. During this initial phase, the water rate 60 is at the highest rate that the well should ever experience. The first stage, T1, last only a short time, sometimes only two to six months.

The second stage T2, which begins at approximately 62 on the water production curve, is defined by a rapid decline in the water volume produced, while the methane production increases 64. During this stage, what is happening in the coal seam reservoir is dewatered which lowers the hydrostatic pressure which allows the methane to desorb and diffuse through the coal matrix and migrate through the coal cleat system which will flow into the wellbore. In order to produce methane gas from coal, the water must first be produced from the coal cleats to reduce the pressure below the gas desorption pressure. By the end of the second stage and the beginning of the third stage T3, the coal bed methane well has been essentially dewatered. Sales of the methane into the pipeline 28 generally do not occur until after the dewatering process has been completed 85.

The third stage T3 for the methane gas, which begins at 58, spans most of the productive economic life of the coal bed methane well. Generally, the coal bed methane well behaves as a dry gas reservoir with the only difference being that the gas is stored in the coal bed by sorption. The dewatered coal bed methane gas is produced at a slightly declining base line 68 that can last for years.

Therefore, the methane well, having now been generally dewatered 85, can be placed on production to a sales pipeline. In accordance with the teachings of this invention, an electric wire line unit 30 will be assembled and the cable 32 will be lowered into the well such that the transducer 34 is placed adjacent the perforations at the coal seam. An electric current will be generated and transmitted down the cable 32 so that the transducer converts the electrical energy to sound energy. This sound energy will have a distinct frequency that will strike the coal seam, and in particular strike the methane molecule adsorbed into the micropores of the coal, and will start to vibrate the molecule quite vigorously. This will give the molecule the added energy to leave the coal face quicker, which will be replaced with another methane molecule which will start the whole process over. The frequency of the transducer must create a sympathetic vibration and create a resonance with the methane molecule to create motion and energy, so that the molecule will vibrate off the coal face.

Thus, after lowering the transducer, it will be necessary to determine the frequency which causes the greatest methane gas production, which will be referred to as the optimum frequency. Determining the optimum frequency can be performed by varying the electric current via the rheostat, and measuring the surface production of methane gas.

Hence, the method of calculating the optimum frequency will include activating the transducer at a first electric current which will in turn produce a first distinct sound frequency, and thereafter measuring the surface production of the methane gas production. Next, a second electric current at a higher voltage is induced which will in turn produce a second distinct sound frequency, and thereafter measuring the surface production of the methane gas production. Next, a third electric current at a higher voltage is induced which will in turn produce a third voltage is induced which will in turn produce a third distinct sound frequency, and thereafter measuring the surface production of the methane gas production.

This process will continue until the operator feels the optimum frequency has been determined. Hence, the optimum frequency is obtained by varying the electric current, and comparing the currents to the actual production observed. Certainly, it is possible to start at higher voltages and continue downward (reducing the voltages) in order to arrive at the optimum frequency.

After obtaining the optimum frequency for production, the well will experience an increase in production, as seen at 70, and the base line 72 represents the increased rate sustainable because of the teachings of the present invention. As will be readily apparent, the increased rate can also lead to increased ultimate production. The transducer will be left in the well and activated in order to sustain maximum production.

Changes and modifications in the specifically described embodiments can be carried out without departing from the scope of the invention which is intended to be limited only by the scope of the appended claims.

I claim:

1. A method of producing coal-bed methane gas from a wellbore comprising the steps of:

drilling a wellbore so that a coal seam is intersected;

casing said wellbore with cement, said casing having a first end and a second end;

providing a valve control means, attached at the first end of said casing, for controlling the methane gas from the wellbore;

perforating said casing at a depth that intersects said coal seam;

fracturing the coal seam;

providing a valve control means at the first end of said casing;

lowering a transducer into the wellbore of said casing to a depth corresponding to the depth of said perforations, said transducer capable of converting electrical energy to a sound energy;

activating said transducer so that the sound energy is produced;

producing the methane gas.

2. The method of claim 1 further comprising the steps of:

varying said energy to said transducer so that variable frequencies are produced;

measuring said production of the methane gas at each of said variable frequencies;

determining a maximum rate of the methane gas production;

comparing the produced frequency with the maximum rate of the methane gas production in order to obtain the optimum frequency of said transducer.

3. The method of claim 2 further comprising the steps of:

producing in situ water from the coal matrix so that the coal seam is dewatering;

producing the methane gas.

4. A system for the production of methane gas from a coal seam comprising:

a casing string, said casing string having a first end and a second end, with said first end being located at a surface level and said second end intersecting the coal seam;

control means, located on said first end of said casing string, for controlling the production of gas and water from the coal seam;

cable means, connected to said control means, for lowering a generating means for generating a sound vibration in response to an electrical energy input into said generating means.

5. The system of claim 4, further comprising:

measurement means, operatively associated with said cable means, for measuring the location of said generating means in said casing string.

6. The system of claim 5, further comprising:

variable electric controller means, operatively associated with said generating means, for varying the electric current to said generating means.

7. The system of claim 6, wherein said generating means is a transducer that converts input electrical energy into the sound vibration, said sound vibration having a frequency.

8. The system of claim 7, wherein said cable means includes a braided line cable of transmitting electrical signals.

9. A method of producing methane gas from a coal seam comprising the steps of:

drilling a bore hole to a coal seam;

completing the well;

producing the methane gas and an in situ water from the coal seam;

lowering a transducer capable of emitting a sound wave;

activating said transducer;

calculating an optimum natural frequency of the methane molecules attached to the coal face.

10. The method of claim 9 wherein the method of calculating an optimum frequency includes:

activating said transducer at a first current;

activating said transducer at a second current;

activating said transducer at a third current; and, continuously measuring the production of methane gas.

11. The method of claim 10 wherein the step of calculating the optimum frequency further includes the steps of:

activating said transducer at a second current;

measuring the production of methane gas.

12. The method of claim 11 wherein the step of calculating the optimum frequency further includes the steps of:

comparing the production from the first current and production from the second current and production from the third current.

13. The method of claim 12 wherein the step of completing the well includes the steps of:

casing said wellbore with cement, said casing having a first end and a second end;

providing a valve control means, located at the first end of said casing, for controlling the methane gas from the wellbore;

perforating said casing at a depth that intersects said coal seam;

fracturing the coal seam;

providing a valve control means at the first end of said casing.

14. The method of claim 13 wherein the step of completing the well further comprising the steps of:

producing the in situ water so that the coal seam is dewatered.

* * * * *